United States Patent [19]

Driska

[11] Patent Number: 5,029,862

[45] Date of Patent: Jul. 9, 1991

[54] OVERHEAD SPINNER

[75] Inventor: John J. Driska, Princeton Junction, N.J.

[73] Assignee: Azrak-Hamway International, Inc., New York, N.Y.

[21] Appl. No.: 575,302

[22] Filed: Aug. 30, 1990

[51] Int. Cl.[5] ..... A63F 7/26

[52] U.S. Cl. ..... 273/119 R; 273/119 A; 273/85 A; 273/118 R; 273/118 A

[58] Field of Search ..... 273/85 A, 85 B, 119 R, 273/119 A, 118 R, 118 A, 126 A

[56] References Cited

U.S. PATENT DOCUMENTS

| | | | |
|---|---|---|---|
| 223,208 | 12/1879 | Disston | 273/14 |
| 568,611 | 9/1896 | Gregson | 273/119 R |
| 681,570 | 8/1901 | McRuer | 273/119 R |
| 1,219,456 | 3/1917 | Hawks | 273/14 |
| 2,083,119 | 6/1937 | Hense | 273/119 R |
| 2,507,716 | 5/1950 | Hughes | 273/118 A |
| 2,678,215 | 5/1954 | Peterson et al. | 273/119 R |
| 3,120,391 | 2/1964 | Fletcher | 273/413 |
| 3,158,373 | 11/1964 | Hastings | 273/118 R |
| 3,166,323 | 1/1965 | Anderson | 273/119 R |
| 3,643,954 | 2/1972 | Meyer et al. | 273/119 A |
| 3,643,955 | 2/1972 | Breslow | 273/119 R |
| 4,061,334 | 12/1977 | Kanno | 273/119 A |
| 4,212,466 | 7/1980 | Wildman et al. | 273/121 R |
| 4,900,026 | 2/1990 | Kulesza et al. | 273/119 A |
| 4,917,383 | 4/1990 | Brown et al. | 273/118 R |

FOREIGN PATENT DOCUMENTS

| | | | |
|---|---|---|---|
| 2305213 | 10/1976 | France | 273/126 A |

*Primary Examiner*—Edward M. Coven
*Assistant Examiner*—Steven B. Wong
*Attorney, Agent, or Firm*—Amster, Rothstein & Ebenstein

[57] ABSTRACT

An overhead spinner assembly, adapted to be mounted on a game in which a projectile is caused to move about a playing surface, includes a spinner for deflecting the movement of the projectile contacting the same, drive means for rotating the spinner in a plane parallel to and slightly above the game playing surface, and a support for mounting the spinner and the drive on the game with the drive above the game playing surface.

17 Claims, 3 Drawing Sheets

OVERHEAD SPINNER

BACKGROUND OF THE INVENTION

The present invention relates to games in which a projectile is caused to move about a playing surface, and more particularly to an overhead spinner for use in conjunction with such games.

The prior art is replete with games in which a projectile is caused to move about a playing surface. In some of these games, such as Rod Hockey, the projectile or puck actually rests on the playing surface, while in other games, such as Air Hockey, the projectile or puck is supported above the playing surface by a cushion of air so that the projectile can be moved more rapidly and easily over the playing surface. In order to make the games even more interesting, and to introduce an element of random chance therein, the games are sometimes provided with powered spinners or deflectors which are capable of intersecting the projectile on certain travel paths and not only deflecting it from the travel path but also deflecting it with an added impetus or drive, reflecting the driven nature of the spinner.

The known spinners have not proven to be entirely satisfactory in use. First, a projectile which is hit by a spinner has a tendency to fly upwardly off the playing surface, and over the edge of any raised rim or border thereabout, so that it can hit the player. Depending upon the hardness of the projectile, the speed with which it is moving (as a result of the impacts caused by the player and by the spinner), and the body portion of the player hit, serious injury to the player may result. Second, in the games where there is otherwise no need for power (such as Rod Hockey without an air cushion), the introduction of the electrical wiring required to power the spinner necessitates approval of the wiring by the Underwriters Laboratory (UL), thereby increasing its cost. Third, in most of these games, the spinner protrudes upwardly through the playing surface so that there must be an aperture in the playing surface. In air cushion-type games (such as Air Hockey) this necessitates gasketing in order to prevent the escape of air from the plenum under the playing surface at the junction of the spinner and the playing surface. And, even in those instances where the spinner does not protrude upwardly through the playing surface, but is rather suspended above the playing surface, the rotation of the spinner is initiated by the passage of the projectile over a sensor on the playing surface (see, for example, U.S. Pat. No. 4,212,466). Thus, the game must be physically designed for use with the spinner, and the spinner cannot be sold as a separate add-on item for use with a conventional game.

Accordingly, it is an object of the present invention to provide an overhead spinner device for use in a game in which a projectile is caused to move about a playing surface.

Another object is to provide such a spinner device which may be incorporated as part of the game as sold or sold separately as an add-on for a conventional game.

A further object is to provide such a spinner device which, in a given embodiment, does not require UL approval because it lacks any electrical wiring.

It is also an object of the present invention to provide such a spinner device which does not necessitate special gasketing in an air cushion-type game.

It is another object to provide such a spinner device which may be safely used without danger of the projectile flying upwardly off the playing surface of the game.

It is a further object to provide such a spinner device which is economical to manufacture and of rugged, sturdy construction.

SUMMARY OF THE INVENTION

It has now been found that the above and related objects of the present invention are obtained in an overhead spinner device adapted to be mounted on a game in which a projectile is caused to move about a playing surface. The device comprises spinner means, drive means and support means. The spinner means deflects the movement of the projectile contacting the same, the drive means rotates the spinner means in a plane parallel to and slightly above the game playing surface, and the support means mounts the spinner means and the drive means on the game with the drive means above the game playing surface.

In a preferred embodiment, the spinner device includes battery means for supplying power to the drive means, the drive means is a motor, and the spinner means is operatively connected to the drive shaft of the motor, the spinner device being characterized by the absence of electrical wires connecting the battery means and the motor. Preferably the motor is disposed above the spinner means, and the spinner means is mechanically connected to the drive shaft of the motor for continuous rotation thereby. Means are optionally provided for connecting the drive means to a remote power supply such as an electrical wall socket.

The spinner device may be configured for sale as add-on equipment for existing games. Where the game playing surface of the game is surrounded by a raised border, the support means is configured and dimensioned to be mounted on the raised border so as to maintain the spinner means in position for contact with a projectile on the game playing surface. The support means is adjustable in length and/or height to enable mounting of the spinner device on different raised borders of different games. Preferably the support means removably mounts the spinner means and the drive means on the game. The spinner device may additionally include means disposed intermediate the bottom of the spinner means and the game playing surface for supporting the spinner means above the game playing surface.

In one preferred embodiment, the spinner device additionally includes a protective cowl or shroud disposed about the spinner means to limit upward deflection of a projectile by the spinner means. The protective cowl or shroud is disposed at least in part outwardly from the spinner means and extends towards, but not as far as, the periphery of the game playing surface. At least a portion of the protective cowl or shroud is transparent.

BRIEF DESCRIPTION OF THE DRAWING

The above brief description, as well as further objects and features of the present invention, will be more fully understood by reference to the following detailed description of the presently preferred, albeit illustrative, embodimetns of the present invention when taken in conjunction with the accompanying drawing wherein.

DETAILED DESCRIPTION OF THE PREFERRED EMBODIMENTS

Figure 1:
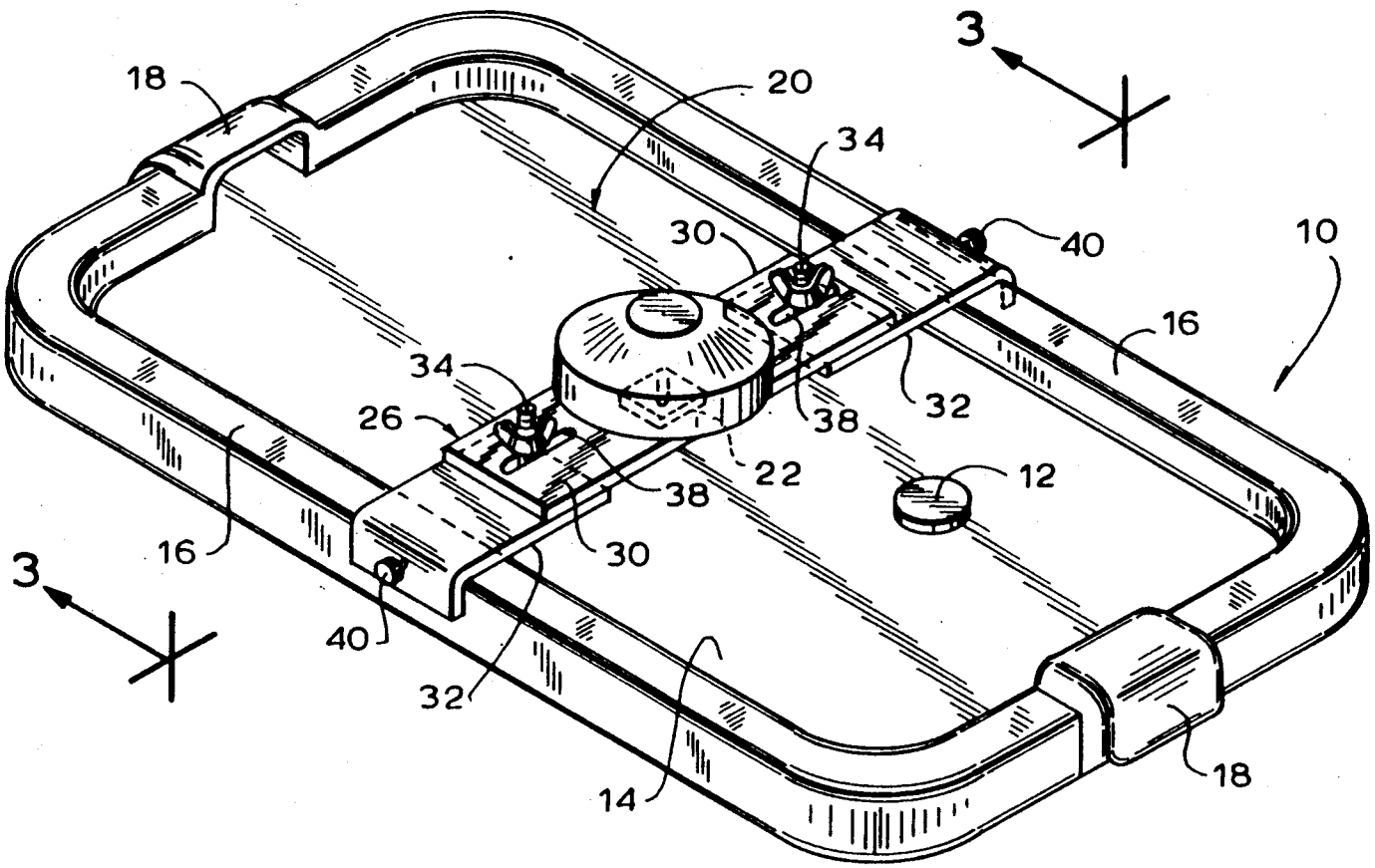
FIG. 1 is an isometric view of a game including the overhead spinner device of the present invention.

Referring now to the drawing, and in particular to FIG. 1 thereof, therein illustrated is a conventional game, generally designated by the reference number 10, in which a projectile 12 is caused to move about a playing surface 14 having a raised rim or border 16 thereabout in order to prevent escape of the horizontally travelling projectile 12 from the game playing surface 14 (i.e., to act as a bumper strip). The game 10 may also include goals 18 at opposite ends of the elongate playing surface 14, as well as a variety of other conventional game components—for example, bats, sticks or the like (not shown) with which the player strikes the projectile 12 in order to drive it over the playing surface 14. The game 10 may be of the straight table type, without an air cushion, or of the air cushion-type. Depending upon the configuration of the playing surface 14, the name ascribed to the projectile 12 and the goal 18, and the like, the game may represent any of a variety of different games such as hockey, soccer, baseball and the like. As the game 10 described thus far is conventional in nature, further details thereof need not be set forth herein.

Figure 2:
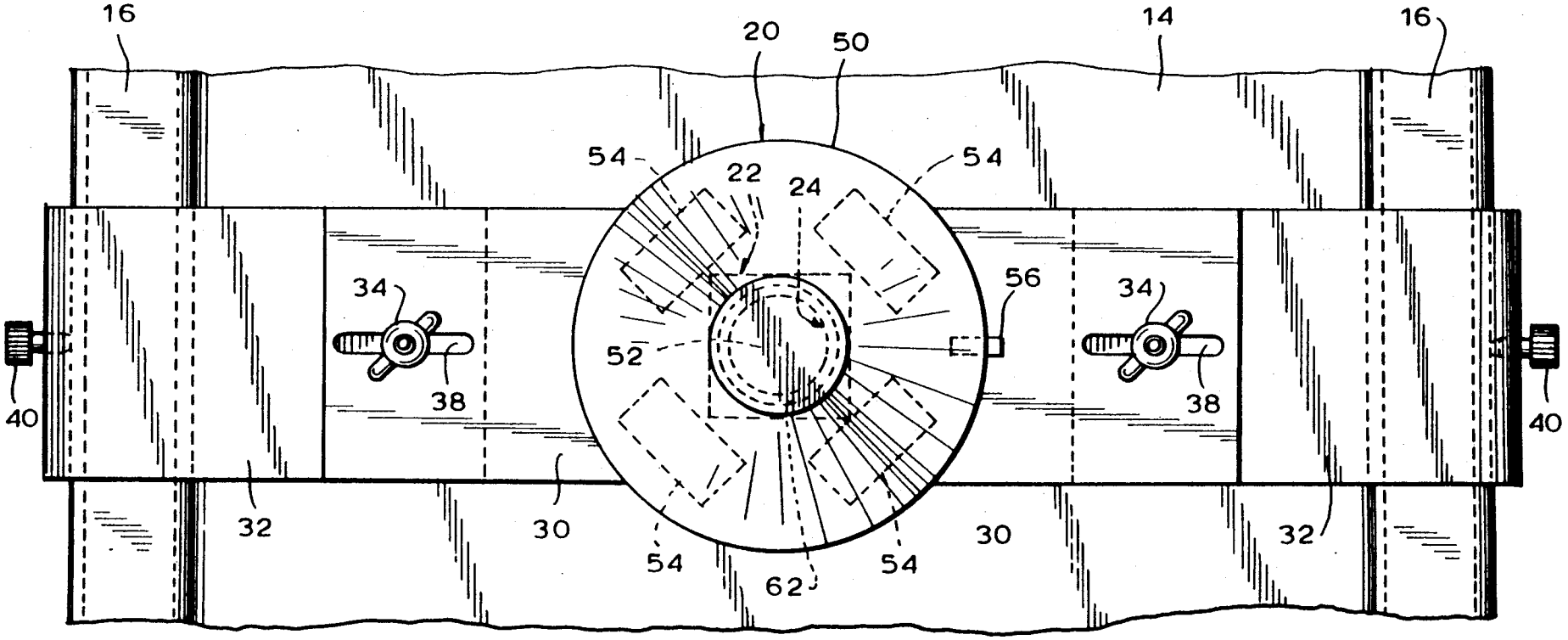
FIG. 2 is a fragmentary top plan view thereof, to an enlarged scale.
Figure 3:
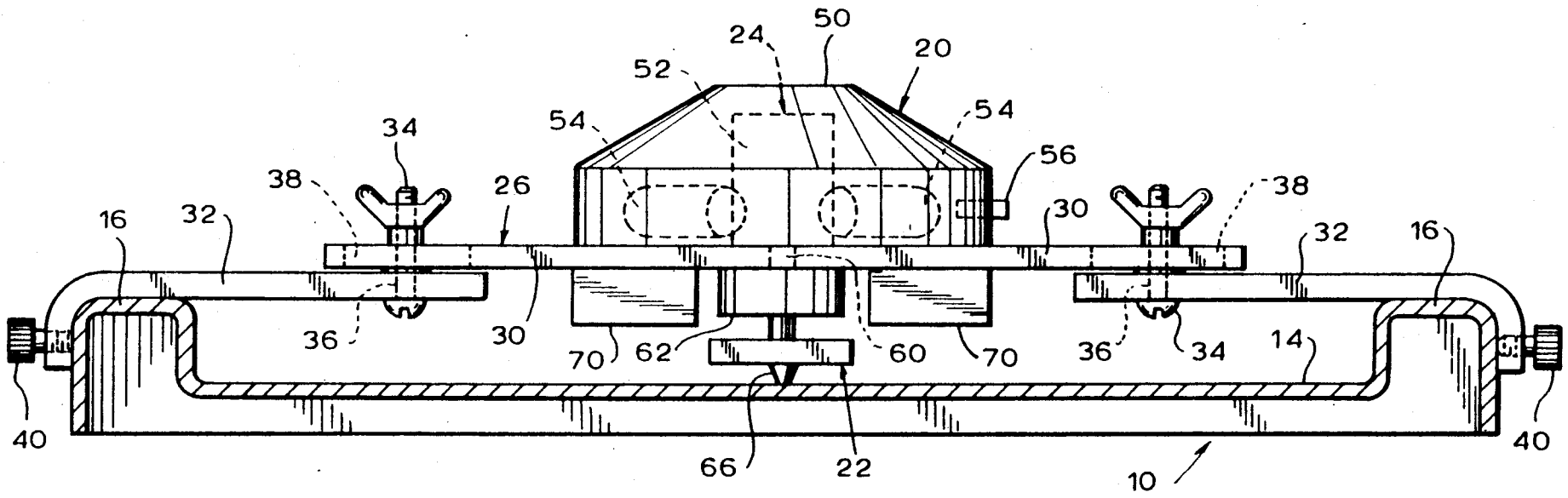
FIG. 3 is a sectional view thereof, also to an enlarged scale, taken along the line 3—3 of FIG. 1.

Referring now to FIGS. 1-3, therein illustrated is an overhead spinner device, generally designated 20, according to the present invention. In its basic aspects, the overhead spinner device 20 includes a spinner generally designated 22 for deflecting the movement of a projectile 12 contacting the same, drive means generally designated 24 for rotating the spinner 22 in a plane parallel to and slightly above the game playing surface 14, and support means generally designated 26 for mounting the spinner 22 and the drive means 24 on the game 10 with the drive means 24 above the playing surface 14.

More particularly, the support means 26 is configured and dimensioned to be mounted on the raised border 16 of the game 10 so as to maintain the spinner 22 in position for contact with the projectile 12 on the playing surface 14. Preferably the support means 26 is adjustable in both length and height in order to enable mounting of the spinner device 20 on different raised borders of different games. Thus, the support means 26 includes a central member 30, a pair of end members 32, and a pair of wing-nut screws 34, each screw 34 passing through an aperture 36 in its respective end member 32 and its respective elongate slot 38 in the central member 30. When the screw 34 is loosened, each screw 34 may be adjusted along the longitudinal length of its respective slot 38 so as to increase or decrease the effective length of the support means 26, thereby enabling it to be used with games having different separations between the raised rims 16 along the longitudinal sides thereof. Further, one or more O-rings or spacers may be placed on each screw 34 intermediate the end member aperture 36 and the central member slot 38 in order to further elevate the central member 30 relative to the end members 32, thereby also elevating the spinner 22 relative to the playing surface 14. Each end member 32 is downwardly curved at its far end, with a set screw 40 passing through an aperture in the downwardly-extending portion so that the end of the set screw 40 may be brought to bear against the vertically extending outer surface of the raised rim 16, thereby to lock the support means 26 in position on the game 10.

The spinner device 20 illustrated is configured for sale as add-on equipment to conventional games and, accordingly, features the above-described support means 26 affording adjustability in both height and length. It will be appreciated, however, that where the spinning device 20 is part of the original manufacture of a game 10, then a simplified support means may be employed since the adjustability feature is no longer required. Indeed, in this case, the support means may be of unitary, one-piece, integral construction (that is, with the central member 30 and end members 32 being replaced by a single member), thereby dispensing with the need for the wing nut screws 34 and O-rings. Furthermore, this simplified support means may be of unitary, one-piece, integral construction with the raised rim 16, thereby dispensing with the need for set screws 40.

Supported on the central member 30 of the support means 26 is a dome-shaped housing 50. Disposed within the housing 50 is a D.C. motor 52 which acts as the drive means 24 for rotating the spinner 22. The motor 52 is preferably vertically oriented with its rotating output shaft 60 extending downwardly through the support means 26 (and in particular the central member 30 thereof). The motor 52 is preferably vertically oriented with its rotating output shaft 60 extending downwardly through the support means 26 (and in particular the central member 30 thereof). The motor 52 is capable of being powered by an internal or portable power supply 54 (four batteries being shown in FIG. 2), by an external or remote power supply of appropriate voltage connected to the motor 52 via a jack 56 (the jack 56 when suitably actuated automatically operatively disconnecting the motor 52 from the batteries 54), or both. Preferably, although not necessarily, the electrical connections between the motor 52 and its power supply, whether it be batteries 54 or the external power supply connected to the jack 56 (such as an electrical wall socket), is provided by contacts rather than by conductive wires in order to eliminate the need for wiring approval by Underwriters Laboratory. Internal/external power supply assemblies of this type are well known in the art and need not be discussed further herein. For a spinner 22 having a weight of about 16 ounces, a small DC motor 52 such as an RC #380, available from Mabucci, is suitable.

As illustrated, the spinner 22 is a square block intermediate in size (in the horizontal plane) between the housing 50, on the one hand, and the gear box 62 and motor 52, on the other hand. The spinner 22 may be secured to the output shaft 60 of motor 52 either directly or, as illustrated, via a gear box 62 which enables the typically high rotational speed of the output shaft 60 to be geared down to a more useful speed for the spinner 22. The gear box 62 may additionally include a safety clutch so that the motor 52 is protected in the event that the rotation of the spinner 22 is blocked—for example, by something becoming wedged between the playing surface 14 and the spinner 22. The precise configuration and dimensions of the spinner 22 will depend upon the effects desired and may vary greatly. For example, the spinner 22 may be a circular or polygonal member and may even be provided with outwardly extending arms. The peripheral extent of the spinner 22 in the plane parallel to and slightly spaced above the playing surface 14 is preferably substantially smaller than the peripheral extent of the housing 50, for reasons which will become apparent hereinafter.

As illustrated, the bottom 70 of the housing 50 extends outwardly beyond and above the spinner 22 so that it is well dimensioned and positioned to act as a protective shroud or cowl to block any accidental upward movement of the projectile 12 accidentally imparted by its contact with the spinner 22. It will be appreciated that the farther the housing bottom 70 is spaced above the playing surface 14, the farther the housing bottom 70 should extend radially from the spinner 22 in order to function as a protective element blocking any upward movement of the projectile 12 which might endanger the players. Depending upon the degree of randomness which it is desired to impart to the game, at least a portion of the protective element may be made transparent to facilitate actual viewing of the spinner 22 by the players. This is especially important where the protective elements 70 extends substantially outwardly from the spinner 22 and thus may, if opaque, block a substantial portion of the playing surface 14 from the view of the players. While in the illustrated embodiment the housing bottom 70 serves as the protective shroud or cowl, clearly the shroud or cowl may alternatively be a separate element, distinct from the housing 50, disposed at least in part outwardly from the spinner 22 and extending towards, but not as far as, the periphery of the game playing surface 14 defined by the raised rim 16.

As a general rule, motors are not designed for use in the illustrated vertical orientation with the output shaft supporting a substantial weight, such as the spinner 22 and possibly a gear box 62. Accordingly, preferably the spinner device 10 additionally includes means 66, disposed intermediate the bottom of the spinner 22 and the game playing surface 14 for supporting the spinner 22 above the playing surface 14, thereby minimizing the gravitational pull on the motor output shaft 60. The supporting means 66 rotates with the spinner 22 and may be an integral depending portion thereof. The bottom of the supporting means 66 should be relatively blunt so as to minimize defacing of the game playing surface 14 through continued use. Where the spinner device is part of the game 10 as sold, the playing surface 14 may be provided with a reinforced pivot point (not shown) adapted to receive the bottom of the supporting means 66 to facilitate rotation thereof without damage to the playing surface 14.

To summarize, the present invention provides an overhead spinner for use in a game in which a projectile is caused to be moved about a playing surface, the spinner device being either incorporated as part of the game as sold or sold separately as an add-on for a conventional game. The spinner device is safe to use (because the projectile cannot fly upwardly off the playing surface of the game), does not necessitate special gasketing in an air cushion-type game, and is economical to manufacture and of rugged, sturdy construction. In one embodiment, the spinner device does not require UL approval because it lacks an electrical wire.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

I claim:

1. An overhead spinner device adapted to be mounted on a game in which a projectile is caused to move about a playing surface, comprising:

(A) spinner means for deflecting the movement of a projectile contacting the same;

(B) drive means for rotating said spinner means in a plane parallel to and slightly above the game playing surface; and (C) support means for mounting said spinner means and said drive means on the game with said drive means above the game playing surface.

2. The spinner device of claim 1 including battery means for supplying power to said drive means.

3. The spinner device of claim 2 wherein said drive means is a motor, and said spinner means is operatively connected to the drive shaft of said motor.

4. The spinner device of claim 3 characterized by the absense of electrical wires connecting said battery means and said motor.

5. The spinner device of claim 4 including means for positioning the same above the playing surface of a game.

6. The spinner device of claim 1 wherein said drive means is a motor disposed above said spinner means, and said spinner means is mechanically connected to the drive shaft of said motor for continuous rotation thereby.

7. The spinner device of claim 1 additionally including means for connecting said drive means to a remote power supply.

8. The spinner device of claim 1 for use where the game playing surface of the game is surrounded by a raised border, said support means being configured and dimensioned to be mounted on the raised border so as to maintain said spinner means in position for contact with a projectile on the game playing surface.

9. The spinner device of claim 8 wherein said support means is adjustable in length to enable mounting of said spinner device on different raised borders of different games.

10. The spinner device of claim 9 wherein said support means is adjustable in height to enable mounting of said spinner device on different raised borders of different games.

11. The spinner device of claim 8 wherein said support means is adjustable in length to enable mounting of said spinner device on different raised borders of different games.

12. The spinner device of claim 1 wherein said support means removably mounts said spinner means and said drive means on the game.

13. The spinner device of claim 1 additionally including a protective cowl or shroud disposed about said spinner means to limit upward deflection of a projectile by said spinner means.

14. The spinner device of claim 13 wherein at least a portion of said protective cowl or shroud is transparent.

15. The spinner device of claim 13 wherein said protective cowl or shroud is disposed at least in part outwardly from said spinner means and extends towards, but not as far as, the periphery of the game playing surface.

16. The spinner device of claim 1, additionally including means disposed intermediate the bottom of said spinner means and the game playing surface for supporting said spinner means above the game playing surface.

17. A self-contained overhead spinner device adapted to be mounted on the raised border of a game in which a projectile is caused to move about a playing surface within the raised border, comprising:

(A) spinner means for deflecting the movement of a projectile contacting the same;

(B) drive means including a battery and a motor for rotating said spinner means in a plane parallel to and slightly above the game playing surface, said spinner means being mechanically connected to the drive shaft of said motor for continuous rotation thereby, and said spinner device being characterized by the absense of electrical wires connecting said battery and said motor;

(C) support means for removably mounting said spinner means and said drive means on the raised border of the game with said drive means above the game playing surface and said spinner means in position for contact with a projectile on the game playing surface, said support means being adjustable in length and height to enable mounting of said spinner device on different raised borders of different games; and (D) a protective cowl or shroud disposed about said spinner means and projecting outwardly therefrom towards, but not as far as, the raised border of the game to limit upward deflection of a projectile by said spinner means.

* * * * *